US011029110B2

(12) United States Patent
Curry et al.

(10) Patent No.: US 11,029,110 B2
(45) Date of Patent: Jun. 8, 2021

(54) MAGAZINE SAFETY

(71) Applicant: Smith & Wesson Inc., Springfield, MA (US)

(72) Inventors: Brett Curry, Monson, MA (US); Gary Zukowski, Ludlow, MA (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 16/822,296

(22) Filed: Mar. 18, 2020

(65) Prior Publication Data

US 2020/0318922 A1 Oct. 8, 2020

Related U.S. Application Data

(60) Provisional application No. 62/829,968, filed on Apr. 5, 2019.

(51) Int. Cl.
*F41A 17/36* (2006.01)
*F41A 17/38* (2006.01)

(52) U.S. Cl.
CPC ..... *F41A 17/36* (2013.01); *F41A 17/38* (2013.01)

(58) Field of Classification Search
CPC ..... F41A 17/36; F41A 17/38; F41A 17/34
See application file for complete search history.

(56) References Cited

U.S. PATENT DOCUMENTS 1,719,384 A * 7/1929 Tansley ..... F41A 17/36 89/137
3,109,345 A 11/1963 Norman
3,857,325 A 12/1974 Thomas
5,388,362 A * 2/1995 Melcher ..... F41A 17/36 42/70.02
5,438,784 A * 8/1995 Lenkarski ..... F41A 17/36 42/70.02
6,457,271 B1 * 10/2002 Vaid ..... F41A 17/36 42/11
6,655,066 B2 * 12/2003 Fluhr ..... F41A 17/36 42/70.02
6,865,979 B1 * 3/2005 Vaid ..... F41A 17/72 42/90
6,952,895 B1 * 10/2005 Zonshine ..... F41A 17/36 42/18
7,096,618 B2 8/2006 McGarry
8,495,832 B2 * 7/2013 Vukovic ..... F41A 17/72 42/70.02
8,590,200 B2 * 11/2013 Domian ..... F41A 17/36 42/70.02
8,726,555 B2 * 5/2014 Carr ..... F41A 17/48 42/70.02

(Continued)

*Primary Examiner* — Joshua T Semick
(74) *Attorney, Agent, or Firm* — John A. Chionchio, Esquire; Ballard Spahr LLP

(57) ABSTRACT

A magazine safety for a semiautomatic firearm uses two levers connected via a floating pin. The first lever is pivotable into and out of the magazine well. The second lever is spring biased to position a spur extending therefrom into the path of a trigger bar. An end of the second lever is connected to the first lever via the floating pin. In the absence of the magazine from the magazine well the first lever will rotate into the magazine well, thereby permitting the second lever to rotate and position the spur in the path of the trigger bar to prevent discharge of the firearm.

22 Claims, 2 Drawing Sheets

(56) References Cited

U.S. PATENT DOCUMENTS

| | | | | |
|---|---|---|---|---|
| 8,935,872 | B2 * | 1/2015 | Zukowski | F41A 17/36 42/70.02 |
| 2011/0162248 | A1 * | 7/2011 | Trpcic | F41A 17/56 42/108 |
| 2012/0085010 | A1 * | 4/2012 | Cook | F41A 19/11 42/7 |
| 2018/0112942 | A1 | 4/2018 | Iwasawa | |

* cited by examiner

FIG. 3
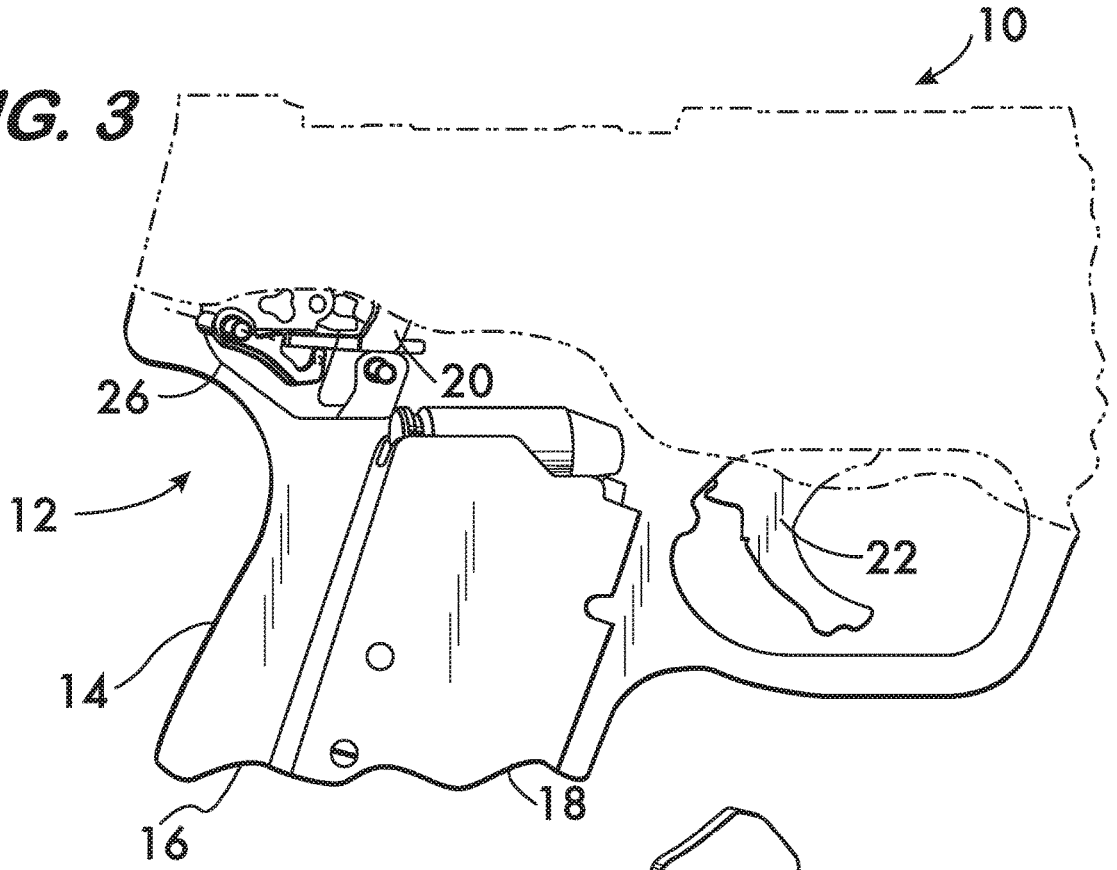
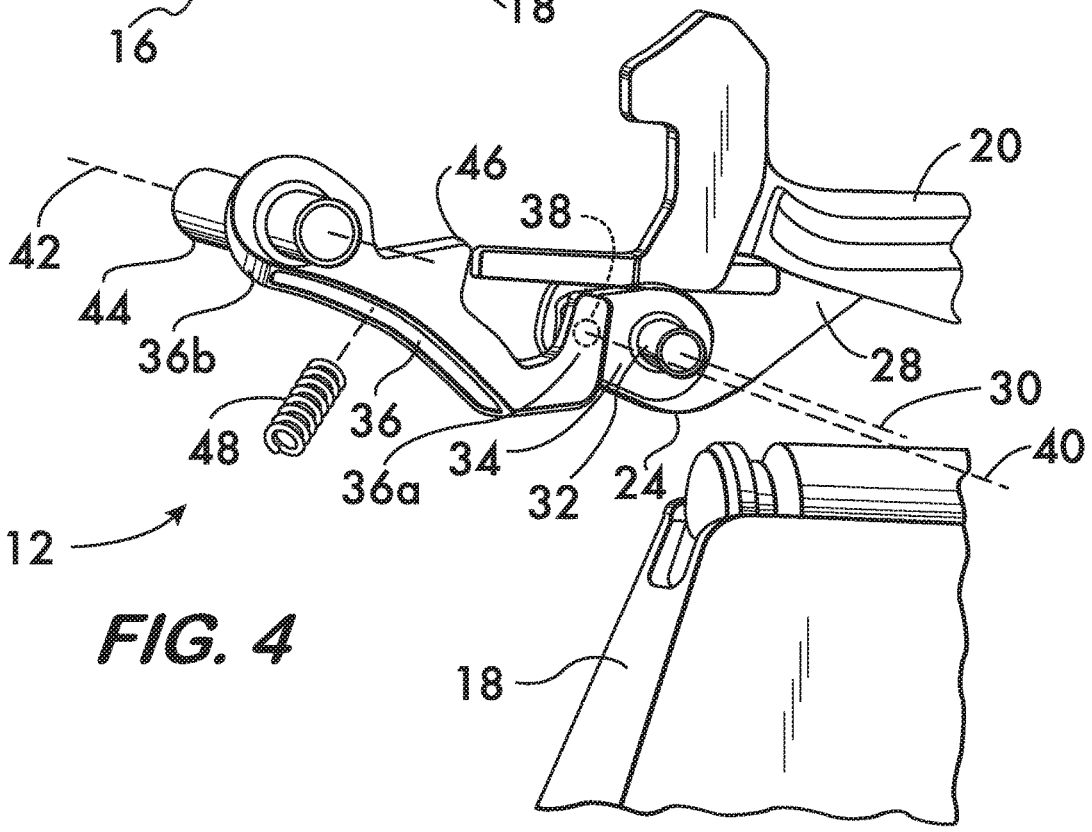
FIG. 4

MAGAZINE SAFETY

CROSS REFERENCE TO RELATED APPLICATIONS

This application is based upon and claims benefit of priority to U.S. Provisional Application No. 62/829,968, filed Apr. 5, 2019, which application is hereby incorporated by reference herein.

FIELD OF THE INVENTION

This invention relates to safety mechanisms for semiautomatic pistols.

BACKGROUND

Magazine safeties prevent a firearm, such as a semiautomatic pistol, from being fired if a magazine is withdrawn (usually even partially withdrawn) from the magazine well of the pistol or other firearm. Magazine safeties are thought to improve the safe handling of firearms, especially for activities related to field stripping and cleaning. Magazine safeties also provide a way to render a firearm inoperable, allowing for safer storage when the magazine is stored separate from the firearm. Furthermore, certain jurisdictions and authorities (notably the state of California, various police departments and government militaries) have enacted legislation or imposed purchasing requirements mandating the use of magazine safeties on firearms sold in the jurisdiction or purchased for use.

SUMMARY

The invention concerns a safety mechanism for a firearm and a firearm having a safety. The firearm, for example, a semiautomatic pistol has a frame defining a magazine well for receiving an ammunition magazine and a trigger bar movably mounted on the frame. In an example embodiment the safety mechanism comprises a first lever mountable on the frame adjacent to the magazine well. The first lever comprises a first arm pivotable about a first pivot axis into and out of the magazine well, and a second arm positioned on an opposite side of the first pivot axis, A second lever has a first end pivotably attached to the second arm and a second end attachable to the frame. The second end is pivotable about a second pivot axis oriented parallel to the first pivot axis. When the first arm pivots into the magazine well the second lever pivots into a position blocking motion of the trigger bar which would discharge the firearm.

An example embodiment further comprises a biasing spring engaging one of the first and second levers for biasing the first arm into the magazine well. In a specific example embodiment the biasing spring acts between the frame and the second lever. By way of further example a spur may extend from the second lever. The spur is engageable with the trigger bar when the first arm pivots into the magazine well.

An example embodiment further comprises a pin extending between the second arm and the first end of the second lever. The pin defines a floating axis of rotation between the second lever and the second arm parallel to the first and second pivot axes.

In another example safety mechanism and firearm, the safety mechanism comprises a housing mountable on the frame adjacent to the magazine well. A first lever is mounted on the housing. The first lever comprises a first arm pivotable about a first pivot axis into and out of the magazine well, and a second arm positioned on an opposite side of the first pivot axis. A second lever has a first end pivotably attached to the second arm and a second end attached to the housing. The second end is pivotable about a second pivot axis oriented parallel to the first pivot axis. When the first arm pivots into the magazine well the second lever pivots into a position blocking motion of the trigger bar which would discharge the firearm.

An example embodiment further comprises a biasing spring engaging one of the first and second levers for biasing the first arm into the magazine well. In a specific example the biasing spring acts between the housing and the second lever. A further example embodiment comprises a spur extending from the second lever. The spur is engageable with the trigger bar when the first arm pivots into the magazine well. An example embodiment further comprises a pin extending between the second arm and the first end of the second lever. The pin defines an axis of rotation parallel to the first and second pivot axes. In an example embodiment the housing comprises at least one plate.

BRIEF DESCRIPTION OF THE DRAWINGS

FIG. 3 shows a partial section view of the semiautomatic firearm of FIG. 1 with the example magazine safety mechanism in "safe" status; and FIG. 4 shows an isometric view of the example magazine safety mechanism in FIG. 3.

DETAILED DESCRIPTION

Figure 1:
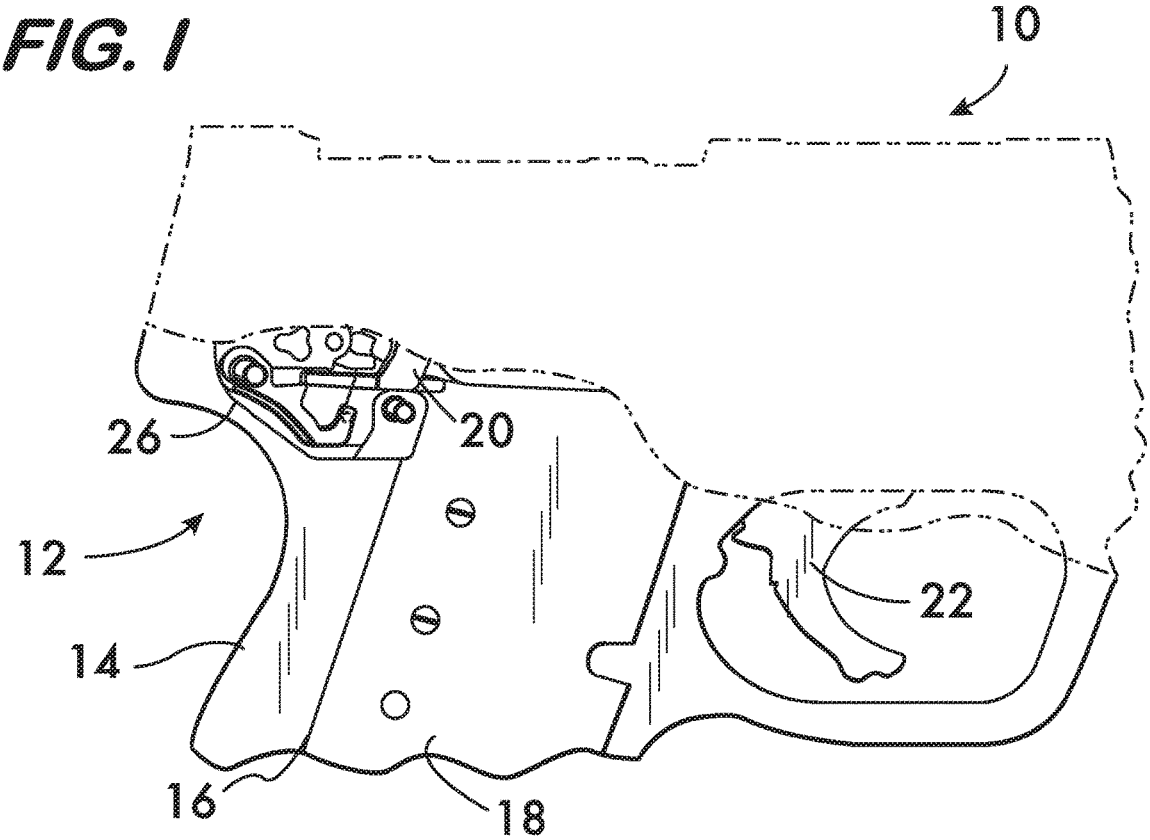
FIG. 1 shows a partial sectional view of a semiautomatic firearm having an example magazine safety mechanism according to the invention, the mechanism shown in "fire" status.

FIG. 1 shows a firearm 10, in this example a semiautomatic pistol, having a magazine safety mechanism 12 according to the invention. Firearm 10 comprises a frame 14 which defines a magazine well 16 for receiving an ammunition magazine 18. Fire control in this example is by means of a trigger bar 20 connected between a trigger 22 and a sear (not shown). The firearm 10 is striker fired, but may also be hammer fired by way of further example.

Figure 2:
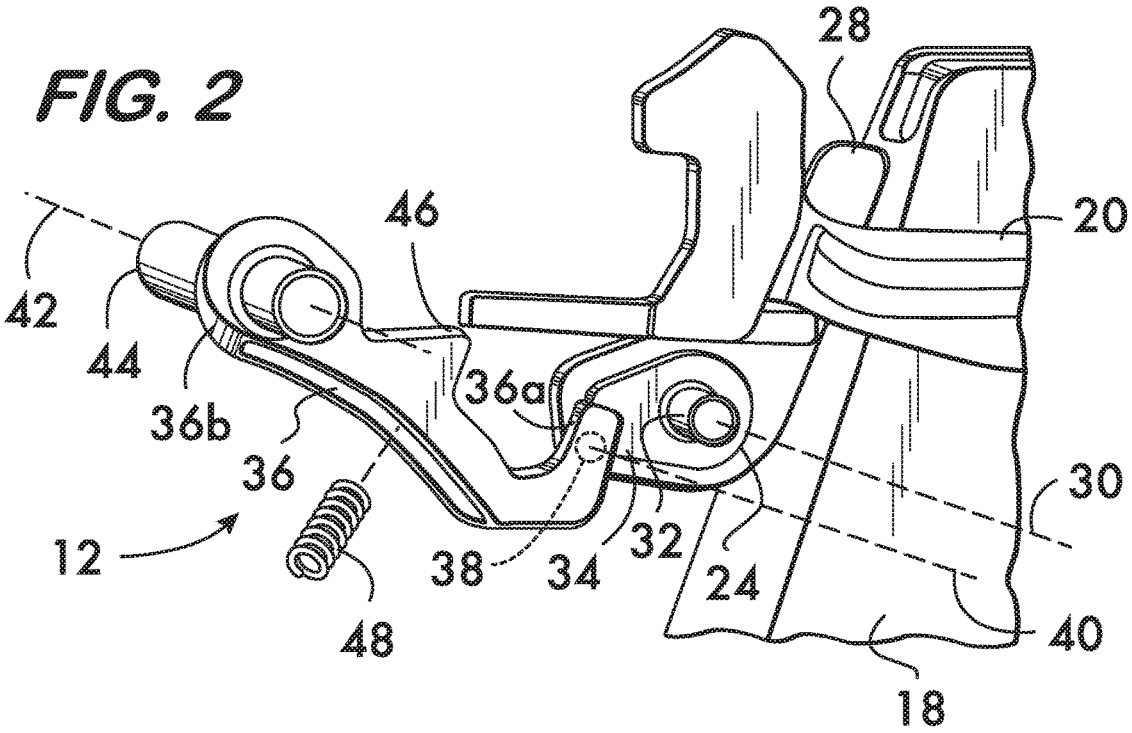
FIG. 2 shows an isometric view of the example magazine safety mechanism in FIG. 1.

FIG. 2 shows the safety mechanism 12 in detail. The example mechanism 12 comprises a first lever 24 mounted on the frame 14. First lever 24 can be mounted directly onto the frame 14, or on a housing, comprising a plate 26 for example (see FIG. 1), which is mounted on the frame. The first lever 24 is mounted on frame 14 adjacent to the magazine well 16 and comprises a first arm 28. First arm 28 is pivotable about a first pivot axis 30 defined by a pin 32 fixed, either directly to the frame 14, or to the housing (plate 26 in this example). First lever 24 further comprises a second arm 34 positioned on an opposite side of the first pivot axis 30. A second lever 36 has a first end **36*a* pivotably attached to the second arm 34. Attachment of the first end 36*a* of the second lever to the second arm 34 is via a floating pin 38 extending between the second lever 36 and the second arm 34. Pin 38 is said to "float" because it is fixed only to the second lever 36 and the second arm 34 thereby forming a toggle joint which can move in translation relatively to the frame 14 (and the housing, when present). Pin 38 thus defines a floating axis of rotation 40 between the first and second levers 24 and 36. The second end 36*b* of the second lever 36 is attached to the frame 14, either directly or via the housing (plate 26). Second end 36***b* is pivotable about a second pivot axis 42 defined by a second pin 44 fixed, either directly to the frame 14 or to the frame via the housing (plate 26). As it is the purpose of the second lever 36 to contact and thereby block motion of the trigger bar 20 when the magazine 18 is not in the magazine well 16 it is advantageous to provide a spur 46 which extends from the second lever. Spur 46 provides positive mechanical engagement between the second lever 36 and the trigger bar 20 when it is desired to prevent discharge of the firearm 10 as described below.

It is advantageous to bias the mechanism 12 so that the first arm 28 is urged to pivot into the magazine well 16 (see FIGS. 3 and 4). As shown in FIG. 2, this biasing is effected by a spring 48 acting either between the frame 14 and the second lever 36, or between the housing (plate 26 for example) and the second lever. A biasing spring could also act between the frame or housing and the first lever 24.

Operation of the example magazine safety 12 according to the invention is illustrated in FIGS. 1 through 4. FIGS. 1 and 2 show the firearm 10 with a magazine 18 in the magazine well 16. Upon insertion into magazine well 16 the magazine 18 contacts the first arm 28 of the first lever 24 and rotates the first lever counterclockwise about the first pivot axis 30. The second arm 34 of the first lever 24 is pivotably connected to the first end 36*a* of the second lever 36 via the floating pin 38, and thus counterclockwise rotation of the first lever 24 causes clockwise rotation of the second lever 36 about the second pivot axis 42. Clockwise rotation of the second lever 36 positions the spur 46 out of the path of the trigger bar 20, thereby allowing the trigger bar to move and discharge the firearm 10 upon a pull of trigger 22.

FIGS. 3 and 4 show the magazine safety 12 with the magazine 18 being removed from the magazine well 16. The absence of the magazine permits the first lever 24 to pivot clockwise about the first pivot axis 30 and into the magazine well 16. Rotation of the first lever 24 is effected by the biasing spring 48 acting on the second lever 36 via the floating pin 38 connecting first and second levers. The absence of resistance to rotation of the first lever 24 thus permits counterclockwise rotation of the second lever 36 about the second pivot axis 42. Counterclockwise pivoting motion of the second lever 36 positions the spur 46 in the path of the trigger bar 20, thereby blocking its motion and preventing discharge of the firearm when there is no magazine in the magazine well.

It is expected that magazine safety mechanisms according to the invention will permit more reliable and safe operation of semiautomatic firearms.

What is claimed is:

1. A safety mechanism for a firearm having a frame defining a magazine well for receiving an ammunition magazine, a trigger bar movably mounted on said frame, said safety mechanism comprising:

a first lever mountable on said frame adjacent to said magazine well, said first lever comprising a first arm pivotable about a first pivot axis into and out of said magazine well, and a second arm positioned on an opposite side of said first pivot axis;

a second lever having a first end pivotably attached to said second arm and a second end attachable to said frame, said second end being pivotable about a second pivot axis oriented parallel to said first pivot axis; wherein when said first arm pivots into said magazine well said second lever pivots into a position blocking motion of said trigger bar which would discharge said firearm.

2. The safety mechanism according to claim 1, further comprising a biasing spring engaging one of said first and second levers for biasing said first arm into said magazine well.

3. The safety mechanism according to claim 2, wherein said biasing spring acts between said frame and said second lever.

4. The safety mechanism according to claim 1, further comprising a spur extending from said second lever, said spur being engageable with said trigger bar when said first arm pivots into said magazine well.

5. The safety mechanism according to claim 1, further comprising a pin extending between said second arm and said first end of said second lever, said pin defining a floating axis of rotation between said second lever and said second arm parallel to said first and second pivot axes.

6. A safety mechanism for a firearm having a frame defining a magazine well for receiving an ammunition magazine, a trigger bar movably mounted on said frame, said safety mechanism comprising:

a housing mountable on said frame adjacent to said magazine well;

a first lever mounted on said housing, said first lever comprising a first arm pivotable about a first pivot axis into and out of said magazine well, and a second arm positioned on an opposite side of said first pivot axis;

a second lever having a first end pivotably attached to said second arm and a second end attached to said housing, said second end being pivotable about a second pivot axis oriented parallel to said first pivot axis; wherein when said first arm pivots into said magazine well said second lever pivots into a position blocking motion of said trigger bar which would discharge said firearm.

7. The safety mechanism according to claim 6, further comprising a biasing spring engaging one of said first and second levers for biasing said first arm into said magazine well.

8. The safety mechanism according to claim 7, wherein said biasing spring acts between said housing and said second lever.

9. The safety mechanism according to claim 6, further comprising a spur extending from said second lever, said spur being engageable with said trigger bar when said first arm pivots into said magazine well.

10. The safety mechanism according to claim 6, further comprising a pin extending between said second arm and said first end of said second lever, said pin defining an axis of rotation parallel to said first and second pivot axes.

11. The safety mechanism according to claim 6, wherein said housing comprises at least one plate.

12. A firearm having a magazine safety mechanism, said firearm comprising:

a frame defining a magazine well for receiving an ammunition magazine;

a trigger bar movably mounted on said frame; wherein said safety mechanism comprises:

a first lever mounted on said frame adjacent to said magazine well, said first lever comprising a first arm pivotable about a first pivot axis into and out of said magazine well, and a second arm positioned on an opposite side of said first pivot axis;

a second lever having a first end pivotably attached to said second arm and a second end attached to said frame, said second end being pivotable about a second pivot axis oriented parallel to said first pivot axis; wherein when said first arm pivots into said magazine well said second lever pivots into a position blocking motion of said trigger bar which would discharge said firearm.

13. The firearm according to claim 12, further comprising a biasing spring engaging one of said first and second levers for biasing said first arm into said magazine well.

14. The firearm according to claim 13, wherein said biasing spring acts between said frame and said second lever.

15. The firearm according to claim 12, further comprising a spur extending from said second lever, said spur being engageable with said trigger bar when said first arm pivots into said magazine well.

16. The firearm according to claim 12, further comprising a pin extending between said second arm and said first end of said second lever, said pin defining a floating axis of rotation between said second lever and said second arm parallel to said first and second pivot axes.

17. A firearm having a magazine safety mechanism, said firearm comprising:

a frame defining a magazine well for receiving an ammunition magazine;

a trigger bar movably mounted on said frame; wherein said safety mechanism comprises:

a housing mounted on said frame adjacent to said magazine well;

a first lever mounted on said housing, said first lever comprising a first arm pivotable about a first pivot axis into and out of said magazine well, and a second arm positioned on an opposite side of said first pivot axis;

a second lever having a first end pivotably attached to said second arm and a second end attached to said housing, said second end being pivotable about a second pivot axis oriented parallel to said first pivot axis; wherein when said first arm pivots into said magazine well said second lever pivots into a position blocking motion of said trigger bar which would discharge said firearm.

18. The firearm according to claim 17, further comprising a biasing spring engaging one of said first and second levers for biasing said first arm into said magazine well.

19. The firearm according to claim 18, wherein said biasing spring acts between said housing and said second lever.

20. The firearm according to claim 17, further comprising a spur extending from said second lever, said spur being engageable with said trigger bar when said first arm pivots into said magazine well.

21. The firearm according to claim 17, further comprising a pin extending between said second arm and said first end of said second lever, said pin defining an axis of rotation parallel to said first and second pivot axes.

22. The firearm according to claim 17, wherein said housing comprises at least one plate.

* * * * *